United States Patent [19]

Singer, Jr.

[11] Patent Number: 4,466,688

[45] Date of Patent: Aug. 21, 1984

[54] SELF-CENTERING PLUG AND SOCKET

[75] Inventor: Loren A. Singer, Jr., Mamaroneck, N.Y.

[73] Assignee: Porta Systems Corp., Syosset, N.Y.

[21] Appl. No.: 422,827

[22] Filed: Sep. 24, 1982

[51] Int. Cl.[3] ..... H01R 13/12

[52] U.S. Cl. ..... 339/252 R; 339/253 R; 339/258 R

[58] Field of Search ..... 339/223 S, 252 R, 252 P, 339/253 R, 273 R, 273 F, 258 R, 258 P

[56] References Cited

U.S. PATENT DOCUMENTS 3,032,741 5/1962 Fitzgerald ..... 339/252 R
3,452,315 6/1969 Deakin ..... 339/252 P

FOREIGN PATENT DOCUMENTS 2002733 10/1969 France ..... 339/223 S
636845 5/1950 United Kingdom ..... 339/252 R

*Primary Examiner*—Joseph H. McGlynn
*Attorney, Agent, or Firm*—Charles E. Temko

[57] ABSTRACT

A self-centering plug and socket construction particularly adapted for connection of telephone components, such as protector modules and adaptors therefor, to be engaged upon a protector block. The construction is characterized in a generally circular socket formed to include a plurality of arcuate segments which are radially deflectable relative to the principal axis thereof, and a plug in the form of a pin having an engageable tip, the cross section of which is in the form of an open polygon which may be compressed laterally with respect to its axis to reduce the effective cross sectional dimension thereof. The construction is used to provide at least a single vapor tight joint which will not corrode in service.

1 Claim, 8 Drawing Figures

SELF-CENTERING PLUG AND SOCKET

BACKGROUND OF THE INVENTION

This invention relates generally to the field of telephony, and more particularly to an improved plug and socket construction suitable for interconnecting interalia protector modules of one make with a connector or protector block of another make by means of an adaptor, although the construction has many other applications in the art.

Typically, the configuration for such adaptation is that of a known Western Electric socket in a protector block or the like having the usual tip and ring connections with a centrally disposed ground pin for each subscriber pair. The module to be adapted has substantially the same connections arranged in different spatial relation. An adaptor to be positioned therebetween includes a main body element having interconnecting bridging pins which have offset portions to compensate for the different spatial relation.

The known Western Electric type sockets are disposed within a synthetic resinous housing in such manner as to be capable of a limited degree of lateral adjustment upon engaging corresponding pins in the adaptor to accommodate normal commercial tolerances. Unfortunately, the lateral movement takes place about an axis disposed inwardly of the point of contact on each socket, so that the adjustment is somewhat pivotal in nature, and tends to move the axis of the socket in noncoaxial relation relative to the engaging pin. This will usually result, when the pin is of circular cross section, in a short line contact of arcuate configuration, one that is prone to corrosion with time because there is not sufficient metal flow between the contact areas to make a vapor tight joint of a type in which the contact area is sufficiently deformed to form an interface which will be impervious to corrosion. With the passage of time, such interconnections become a source of noise on the telephone line, often of sufficient volume to require replacement of the interconnecting parts. Since the socket is normally part of an installed connector block, the correction of this problem must be made in the pins forming part of the adaptor, or the replacement module.

SUMMARY OF THE INVENTION

Briefly stated, the invention contemplates the provision of an improved interconnecting pin configuration which possesses a substantial degree of resiliency in a plane normal to its axis, and which is of polygonal open cross sectional configuration so as to provide at least one point contact which forms a vapor tight joint upon engagement with a corresponding socket which simultaneously adjusts for misalignment. The preferred cross sectional shape is that of a generally equilateral triangle open at one corner to form a pair of spaced edges which may be moved together under compression to provide a degree of lateral adjustment. Depending upon the degree of lateral adjustment required, contact will be made at all of the corners of the polygonal configuration. Where an annular crimp is provided in the socket, the contact area will be a point rather than a curved line.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
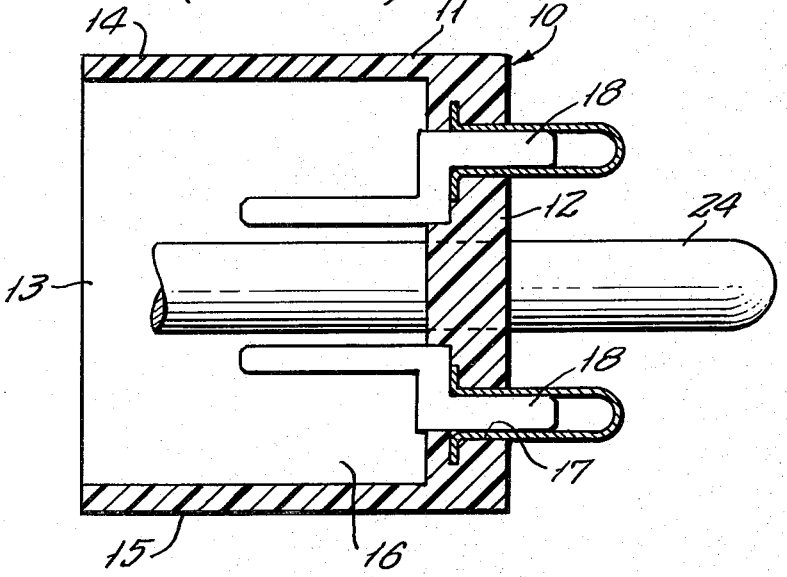
FIG. 1. (PRIOR ART)
FIG. 1 is a longitudinal section view of a prior art adaptor suitable for interconnecting a telephone protector module of one make with a protector block of another make.

With reference to FIG. 1 in the drawing, reference character 10 designates a prior art adaptor used for interconnecting the protector modules of one make with a telephone protector block of another make. The adaptor normally includes a synthetic resinous housing 11 including a relatively thick base wall 12, a pair of side walls, one of which is indicated by reference character 13, and a pair of end walls 14 and 15. The walls 13–15 define a socket 16 for the reception of the inner end of a known protector module (not shown). The base wall 12 includes a plurality of through bores 17 mounting offset pins 18, the outer ends of which are provided with press fit sleeves.

Figure 2:
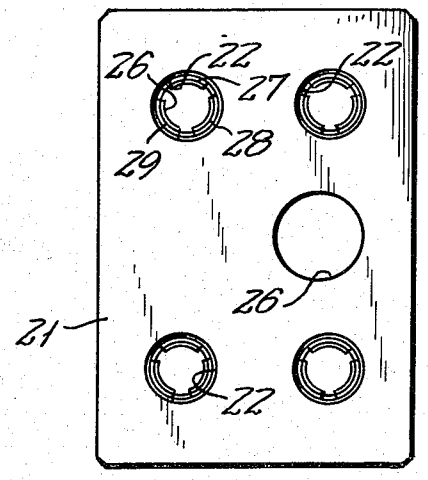
FIG. 2. (PRIOR ART)
FIG. 2 is an end elevational view of a corresponding socket element engageable with the adaptor shown in FIG. 1.

FIG. 2 shows an end wall surface 21 of a corresponding receptacle, including openings 22 for tip and ring circuits as well as a larger opening 23 accommodating a ground pin 24. Each of the openings 22 mounts a conductive socket 26 normally including first, second, and third segments 27 and 28 which are capable of individual flexing in a radial direction. This flexing, while of relatively limited permissible scope, occurs about a pivot point (not shown) spaced inwardly of the tip thereof, and is of a pivotal nature, so that when the engaging pin is a fixed cross section, effective contact is available only over a limited arcuately shaped area. Each of the segment 27–29 is provided with a flared end 30 and a constricted contact portion 31 which performs a detent function with a correspondingly shaped pin.

Figure 3:
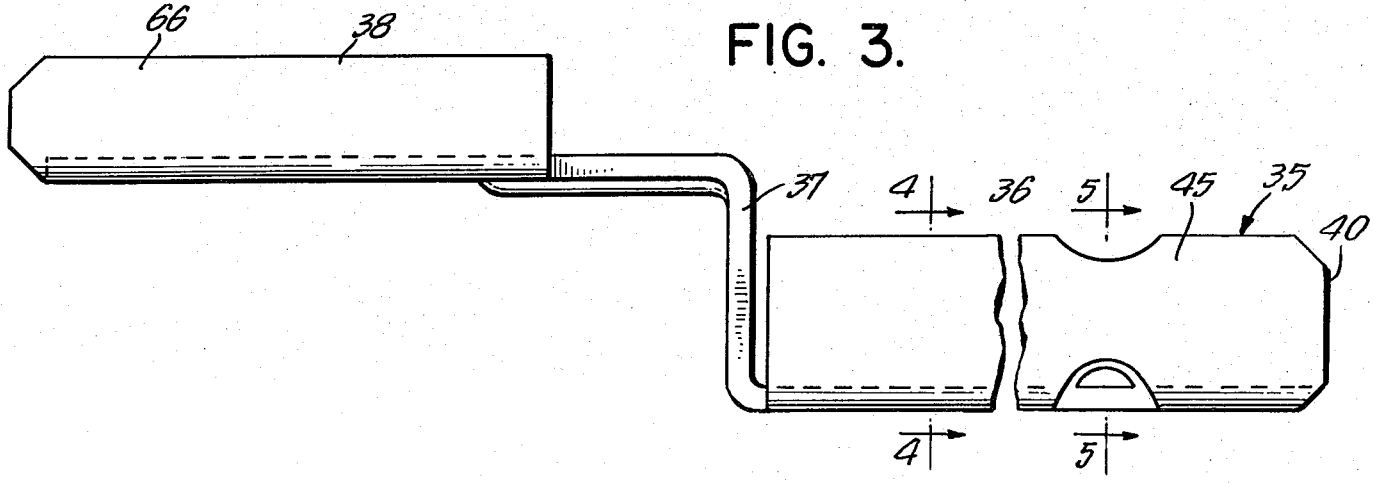
FIG. 3 is a side elevational view of an improved conductor pin for use in the adaptor of FIG. 1, which embodies the invention.
Figure 6:
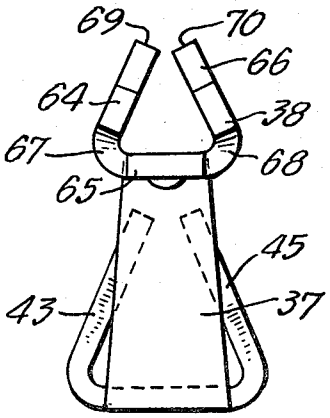
FIG. 6 is an end view of FIG. 3.

Referring to FIG. 3, reference character 35 indicates an improved pin which is substituted for each of the pins 18 in FIG. 1. The pin 35 is characterized in being of hollow polygonal cross section. It includes a first longitudinal portion 36, an offset portion 37 and a second longitudinal section 38. The portion 36 includes a chamfered terminal 40 leading to the polygonally shaped section 41.

Figure 4:
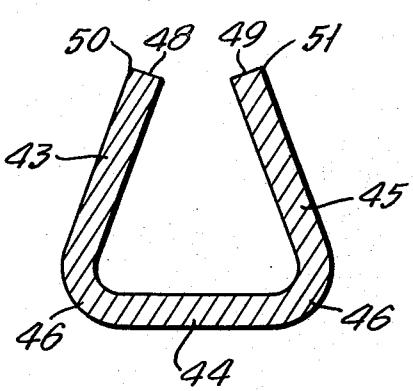
FIG. 4 is a sectional view as seen from the plane 4—4 in FIG. 3.
Figure 8:
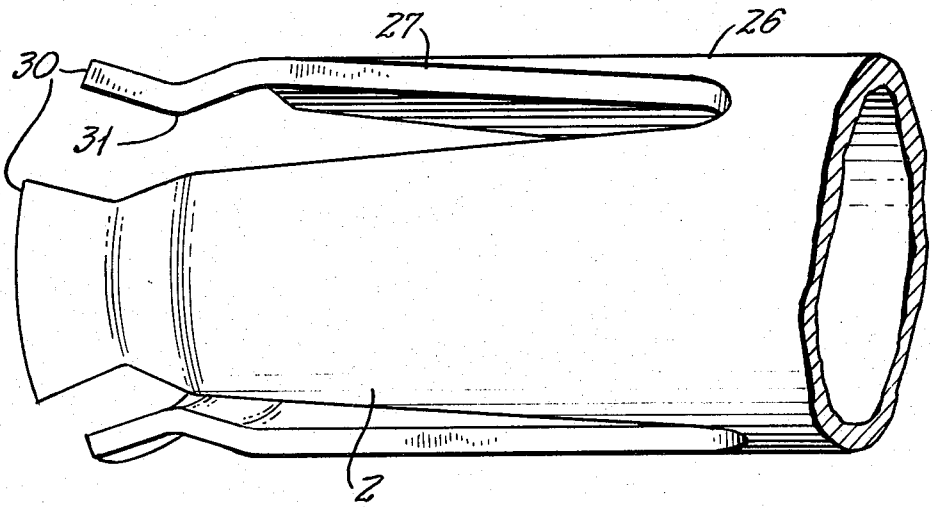
FIG. 8 is a perspective view of the socket element.
Figure 7:
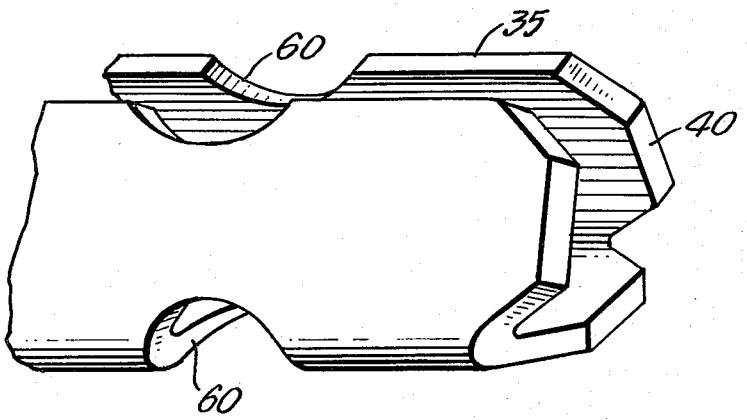
FIG. 7 is a perspective view of the conductor pin.

FIG. 4 is a cross sectional view, and illustrates first, second, and third longitudinally extending walls 43, 44, and 45, respectively, which are joined by two 120° bent portions 46 and 47. The first and third walls 43 and 45 terminate in edge surfaces 48 and 49 which form apices of right angles at 50 and 51 which are points of contact.

The corresponding socket, includes, as has been mentioned, three separate segments, which are positioned at 120° intervals, so that normally, the apices 50 and 51 and the outer surfaces of the bent portions 46 and 47 will each make contact with one of the three arcuate segments of the socket.

Figure 5:
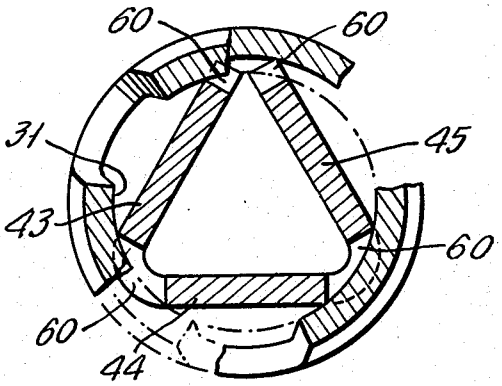
FIG. 5 is a sectional view corresponding to that seen in FIG. 4, and showing the structure of FIG. 3 engaged within a corresponding prior art socket.

As seen in FIG. 5, the pin 35 is preferably provided with corresponding notches 60 corresponding to the cross sectional configuration of the constricted portions 31 to provide a detent action when the pin is engaged within the socket, and assure a number of contact points through which current may flow. Because the pin itself may be resiliently compressed from the position shown in FIG. 4 to the position shown in FIG. 5, and the arcuate segments of the socket are also capable of lateral movement, normal commercial tolerances resulting in misalignment are more than adequately compensated for, and in each case, normally two point contacts will form a vapor proof joint assuring good electrical conductivity, even if certain of the other contact areas corrode.

The second longitudinal portion 38 is generally similar, including first, second, and third walls 64, 65, and 66, interconnected by bent portions 67 and 68, and forming end edge surfaces 69 and 70. Since this portion will normally engage a conventional circular socket in the protector module, the provision of notches similar to the notches 60 is unnecessary.

Because the elastic modulus of the pin in a plane perpendicular to the principal axis thereof is very high, only a very limited distortion from open to closed position (compare FIGS. 4 and 5) is necessary to develop very substantial forces which are exerted over relatively small contact areas. Thus, individual misalignments normally occurring where a large number of pins and sockets are simultaneously engaged is readily compensated without difficulty.

I wish it to be understood that I do not consider the invention limited to the precise details of structure shown and set forth in this specification, for obvious modifications will occur to those skilled in the art to which the invention pertains.

I claim:

1. In a combination pin and socket construction for establishing electrical conductivity, said socket defining a generally arcuately-shaped recess for the reception of said pin, the improvement comprising: said pin being of generally open polygonal cross section including a plurality of walls longituidinally interconnected by bent portions, two of said walls terminating in longitudinally extending parallel edges; said pin being resiliently compressible transversely of its principal axis to reduce the effective width thereof upon engagement with said socket, said plurality of walls being three in number, and interconnected by two 120 degree bent portions; said socket having an arcuately constricted contact area, said pin having corresponding notches in the parallel edges and bent portions thereof corresponding in configuration to said constricted contact area, said notches being of generally arcuate configuration and of a radius greater than said constricted contact area to effect point contact therewith upon engagement.

* * * * *